US007002523B2

(12) United States Patent
Noro

(10) Patent No.: US 7,002,523 B2
(45) Date of Patent: Feb. 21, 2006

(54) ANTENNA DEVICE

(75) Inventor: Junichi Noro, Akita (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 37 days.

(21) Appl. No.: 10/785,939

(22) Filed: Feb. 26, 2004

(65) Prior Publication Data

US 2004/0183734 A1 Sep. 23, 2004

(30) Foreign Application Priority Data

Mar. 18, 2003 (JP) ..... P.2003-73220

(51) Int. Cl.
*H01Q 1/32* (2006.01)

(52) U.S. Cl. ..... 343/713; 343/715; 343/711; 343/702; 343/757; 343/833

(58) Field of Classification Search ..... 343/713, 343/715, 702, 757, 833, 711; H01Q 1/32
See application file for complete search history.

(56) References Cited

U.S. PATENT DOCUMENTS 5,583,522 A * 12/1996 Radomski et al. ..... 343/715
5,859,617 A * 1/1999 Fujikawa ..... 343/702
6,486,841 B1 * 11/2002 Imahigashi ..... 343/715
6,646,613 B1 * 11/2003 Cheng ..... 343/721
6,762,727 B1 * 7/2004 Rochford et al. ..... 343/713
2003/0076270 A1 * 4/2003 Okamoto ..... 343/713

FOREIGN PATENT DOCUMENTS

JP 10-22718 1/1998

* cited by examiner

*Primary Examiner*—Don Wong
*Assistant Examiner*—Binh Van Ho
(74) *Attorney, Agent, or Firm*—Whitham, Curtis & Christofferson, P.C.

(57) ABSTRACT

To enable an antenna device to be easily mounted to a roof or the like, and to realize a highly reliable state or the antenna device after mounted. The invention relates to an antenna device comprising an antenna element, and a bottom cover and a top cover which cover the antenna element. The bottom cover includes a base projection to be inserted into an opening formed in a mounting part, a washer having an elastic force being fitted over this base projection, and the washer comes into contact with an inner face of the mounting part thereby enabling the antenna device to be mounted and fixed. The washer is inserted into the opening in the mounting part in a state fitted over the base projection, and recovered to its original shape by the elastic force after the insertion, thereby to be brought into contact with the inner face of the mounting part.

8 Claims, 7 Drawing Sheets

ANTENNA DEVICE

BACKGROUND OF THE INVENTION

1. Field of the Invention

The present invention relates to an improvement in a mounting structure of an antenna device with respect to a roof or an automobile, for example.

2. Description of the Related Art

An on-vehicle antenna device can be installed by mounting an antenna module to a desired position of a vehicle body, for example, a roof or a neighboring place. A helical antenna element is an omit-directional antenna element, and suitable for receiving various signals such as satellite radio broadcasting signals, broadcasting global positioning system (GAPS) signals, cellular telephone signals, etc.

The related art is Japanese Patent Publication No. JP-A-10-22718.

By the way, in the above described on-vehicle antenna device, in order to take out an output of the antenna element, it is necessary to draw a lead cable into the vehicle and connect it to a receiving apparatus or the like. For this purpose, a hollow base projection is integrally provided on a bottom cover which contains the antenna element, and this base projection is inserted into an opening formed in the roof so that the lead cable can be drawn into the vehicle by way of the base projection.

As the conventional mounting structure of the antenna device to the roof, there has been known such a structure that the above described base projection provided on the bottom cover is in a form of a bolt which is integral with the bottom cover, and this bolt is fixed to the roof by tightening it with nuts by way of a washer. In this case, it is necessary to insert the base projection Or the bottom cover into the opening formed in the roof from the outside of the vehicle, and to tighten it with nuts by way of the washer from the inside of the vehicle room.

According to such conventional mounting structure, it has been necessary to conduct, at the same time, both a work for inserting the base projection provided on the bottom cover of the antenna device into the opening formed in the roof, in the outside of the vehicle room, and a work for tightening the nuts from the inside of the vehicle room. Therefore, the mounting work has become cumbersome, not only because at least two workers are required, but because a number of steps are required for the mounting work.

SUMMARY OF THE INVENTION

The present invention has proposed in view of these circumstances of the prior art, and an object of the invention is to provide an antenna device having a novel mounting structure which enables the antenna device to be easily mounted to a roof of an automobile even by one person, and can maintain the antenna device in a highly reliable state after mounted.

In order to attain the above described object, there is provided, according to the invention, an antenna device comprising an antenna element, and a bottom cover and a top cover which cover the antenna element, characterized in that the aforesaid bottom cover includes a base projection to be inserted into an opening formed in a mounting part, a washer having an elastic force being fitted over this base projection, and that the aforesaid wash or comes into contact with an inner face of the mounting part thereby enabling the antenna device to be mounted and fixed.

In the antenna device according to the invention, the washer having the elastic force is employed, and therefore, when the washer in a state fitted over the base projection, for example, is pushed into the opening formed in the mounting part, the washer will be recovered to its original shape by the elastic force after the insertion, and will be brought into contact with the inner face of the mounting part, thereby allowing the antenna device to be mounted and fixed. Such mounting work can be done by one person, and a simple work of only pushing it from the outside of the vehicle room would be sufficient.

DESCRIPTION OF THE PREFERRED EMBODIMENTS

Now, the antenna device according to the invention will be described in detail referring to the attached drawings.

Figure 1:
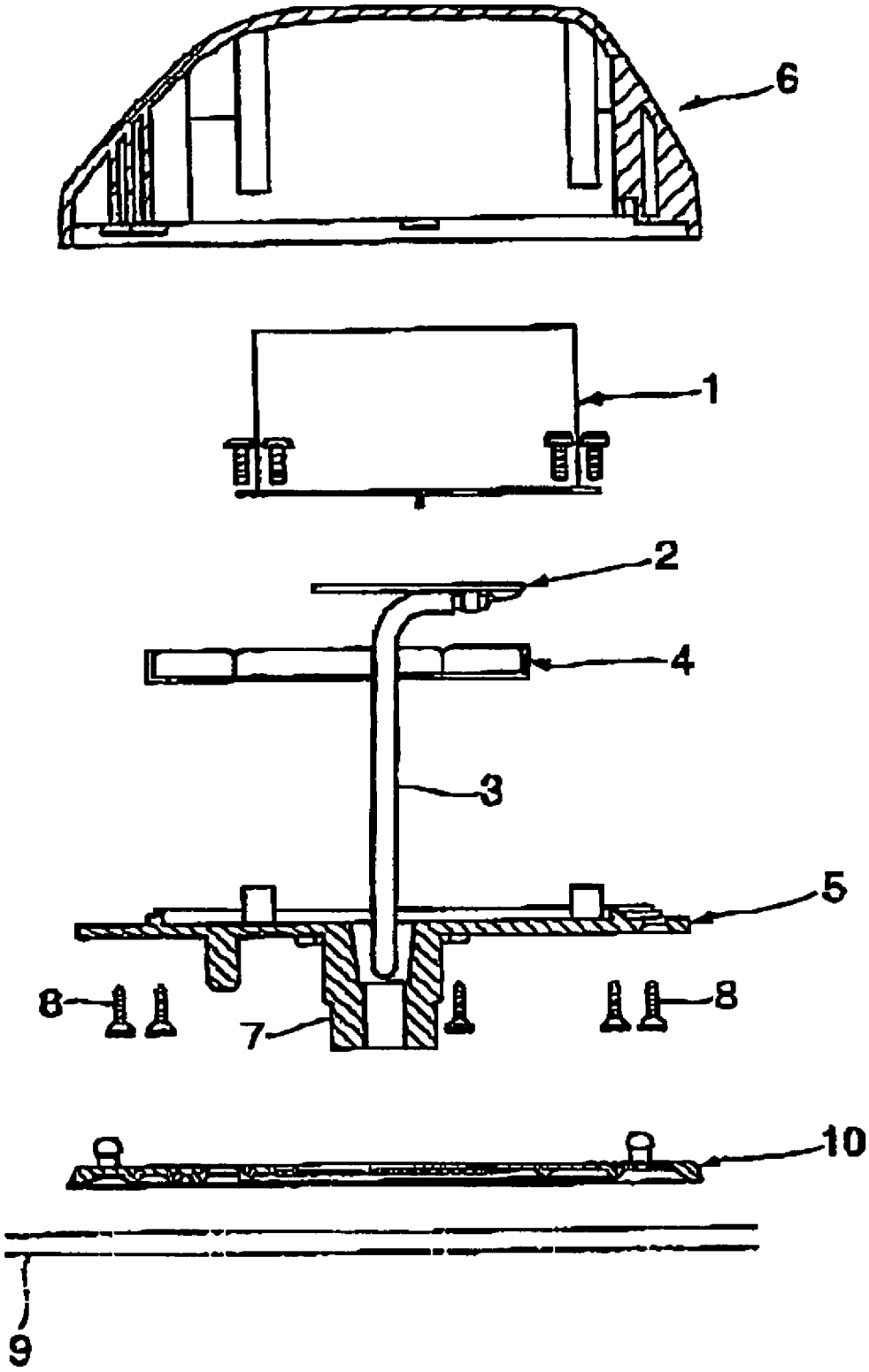
FIG. 1 is a side view showing, in an exploded manner, an antenna device to which the invention is applied.

FIG. 1 is a view showing the antenna device to which the invention is applied, in an exploded manner. This antenna device includes an antenna element 1, a printed board 2 and a lead cable 3 for attaining connections between this antenna element 1 and exterior appliances, a shield case 4 which contains and shields electronic components such as a low noise amplifying circuit mounted on the printed board at a bottom race side of the antenna element 1, and a bottom cover 5 and a top cover 6 which cover the antenna element 1, the printed board 2, the shield case 4 and so on.

The above described antenna element 1 has, for example, an omni-directional helical antenna element mounted thereon, and receives various signals such as satellite radio broadcasting signals, global positioning system (GAPS)

signals, cellular telephone signals, etc. The signals received are introduced to receiving apparatuses or the like inside the vehicle by way of the above described printed board 2 and the lead cable 3.

The above described bottom cover 5 is provided with a base projection 7 in a substantially cylindrical shape projected downward. The above described lead cable 3 is passed through this base projection 7 to be drawn into the vehicle. Moreover, this bottom cover 5 is mechanically fixed to the top cover 6 by means of screws 8.

The antenna device which has been assembled is mounted to a desired position (a roof or the like) of an automobile body, for example. The antenna device is mounted in such a manner that the bottom cover 5 may be in contact with a roof 9 of the automobile. On this occasion, a gasket 10 made of rubber is interposed between the bottom cover 5 and the roof 9 of the automobile to prevent intrusion of rainwater or the like.

The antenna device is fixed to the roof 9 by fitting a washer made of plastic over the base projection 7 provided on the bottom cover 5, and by inserting them into an opening formed in the roof. A mounting structure of this antenna device to the roof 9 will be described hereunder.

Figure 2:
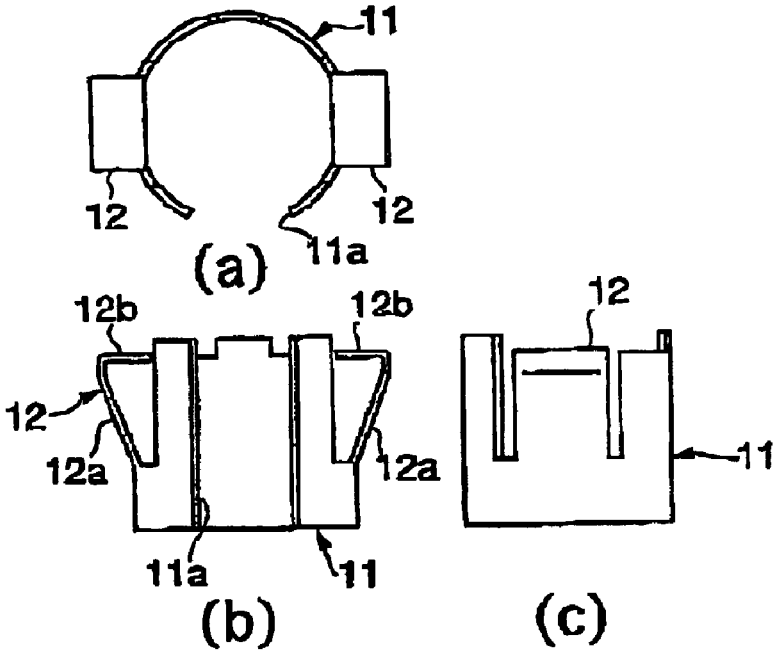
FIG. 2 shows one embodiment of a semiannular washer, in which (a) is a plan view, (b) is a front view, and (c) is a side view.

FIG. 2 shows one embodiment of a washer 11. This washer ii is an annular member made of metal, and provided with a cut-out 11*a* in its one part and locking claws 12 at two right and left positions. Each of the locking claws 12 has an elastic portion 12*a* which is inclined so as to outwardly spread and a locking piece 12*b* which is folded inwardly. The locking claws 12 can be pushed inwardly against an elastic force, and will be recovered to their original shape by the elastic forcer by releasing the push-in force.

Figure 3:
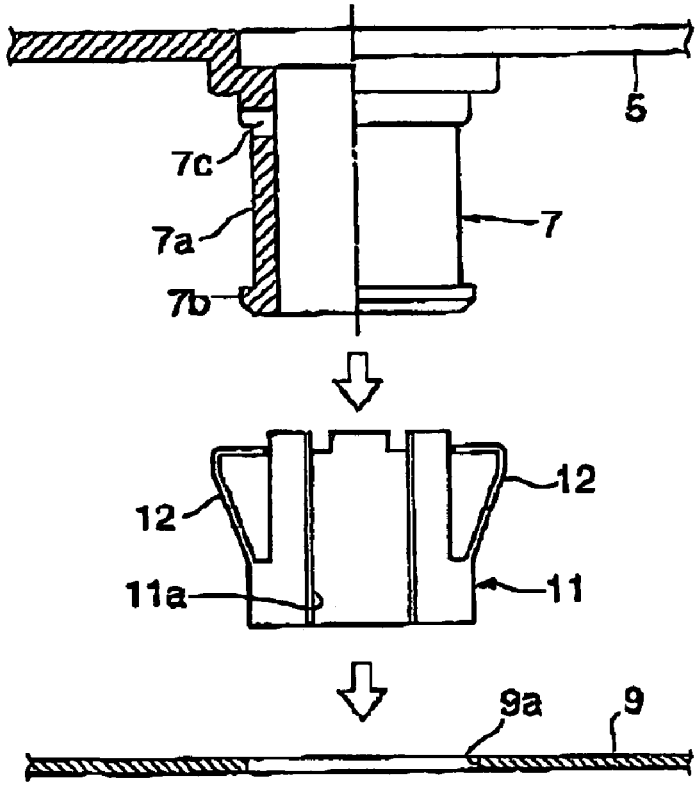
FIG. 3 is a view showing a step of mounting a bottom cover with tubular and the washer to a roof.

On the other hand, the base projection 7 of the bottom cover 5 includes, as shown In FIG. 3, a washer engaging portion 7*a* which has substantially the same outer diameter as inner diameter of the above described washer 11, a locking rib 7*b* which is formed so as to project from an outer peripheral face of a tip end part of the washer engaging portion 7*a* thereby to support a bottom face of the washer 11, and locking holes 7*c* into which the locking pieces 12*b* of the locking claws 12 of the washer 11 are adapted to be inserted.

When the base projection 7 of the bottom cover 5 is pushed into the washer 11, the washer 11 will be spread since the cut-out 11*a* has been formed, and the washer 11 will be engaged with the washer engaging portion 7*a* of the base projection 7. When the base projection 7 in this state is further pushed into an opening 9*a* formed in the roof 9, the locking claws 12 of the washer 11 will be pushed inwardly against the elastic force, and the washer 11 in a state fitted over the base projection 7 will be inserted into the vehicle room through the opening 9*a* formed in the roof 9.

Figure 4:
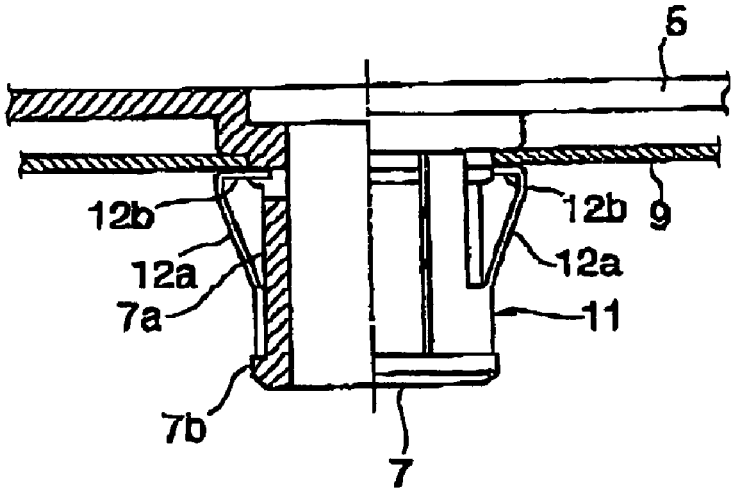
FIG. 4 is a view partly cut away showing a state in which the bottom cover and the washer have been mounted to the roof.

After the washer 11 has passed through the opening 9*a* formed in the roof 9, a pressure which has been exerted on the locking claws 12 will be released, and the locking claws 12 will be recovered to their original shape by the elastic force so as to project outwardly, as shown in FIG. 4. As the results, the locking pieces 12*b* of the washer 11 will be brought into contact with an inner face of the roof 9, and the locking rib 7*b* provided on the base projection 7 of the bottom cover 5 will come into contact with the bottom face of the washer 11 thereby allowing the antenna device to be mounted and fixed.

Operations as described above can be performed by one worker in the outside of the vehicle room, for example. Moreover, complicated works such as fixing with screws are unnecessary, and the mounting work can be extremely easily done by the simple push-in operation.

By the way, there is an anxiety in the above described embodiment that a displacement may occur in mounting direction of the antenna device, because the washer 11 and the base projection 7 have a circular shape. For the purpose of avoiding such a drawback, a locator pin for preventing rotation, for example, maybe uprightly provided on the bottom cover 5, and by inserting this locator pin into a hole formed in the roof 9, it would be possible to determine the mounting direction reliably and accurately.

Figure 5:
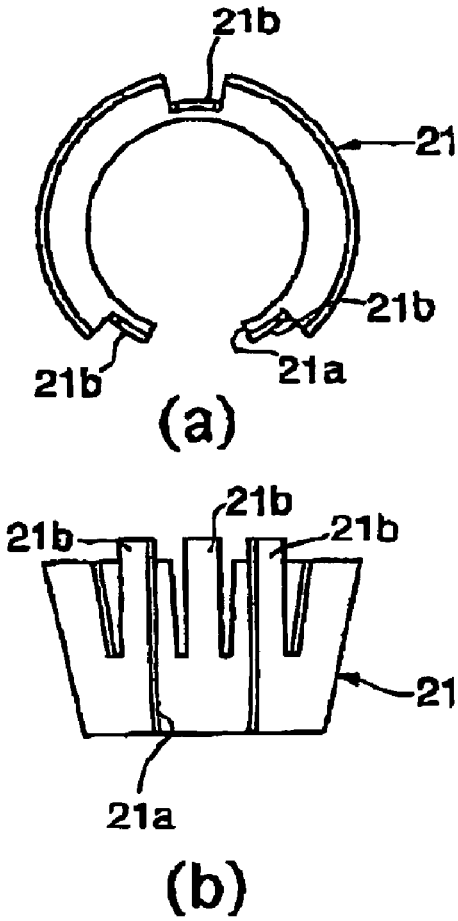
FIG. 5 shows another embodiment of the washer, in which (a) is a plan view, and (b) is a front view

FIG. 5 shows an embodiment of a washer 21 having a different shape. This washer 21 has also an annular shape. However, the washer 21 has an inverted frustum shape which is inclined so as to be gradually enlarged in diameter upwardly, and is also provided with a cut-out 21*a*. There are further provided a plurality of bottom cover contact pieces 21*b* which are slightly projected upwardly, at three positions spaced at an equal angle, in this embodiment.

Figure 6:
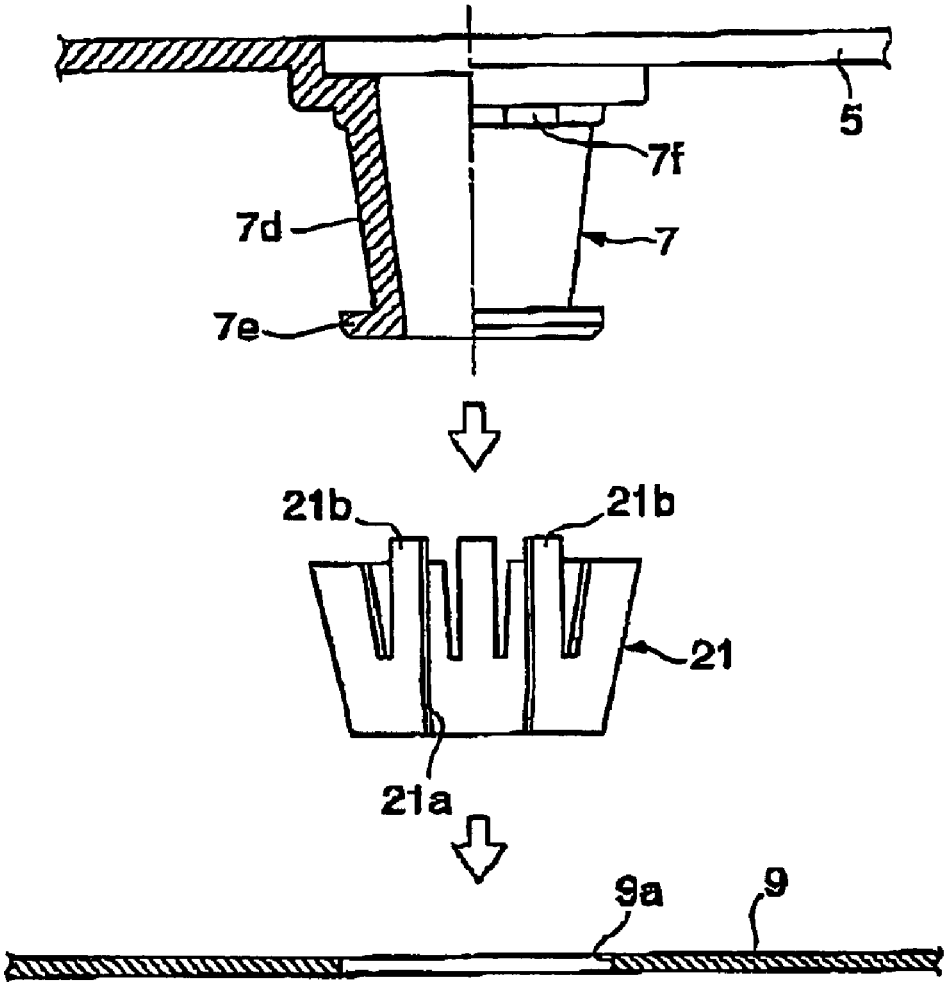
FIG. 6 is a view showing a step of mounting the bottom cover and the washer to the roof.

On the other hand, the base projection 7 of the bottom cover 5 includes, as shown in FIG. 6, a washer engaging portion 7*d* which has an inverted frustum shape in correspondence with the shape of the above described washer 21, a locking rib 7*e* which is formed so as to project from an outer peripheral face of a tip end part of the washer engaging portion 7*d* to support a bottom face or the washer 21, and locking holes 7*f* into which the bottom cover contact pieces 21*b* of the washer 21 are adapted to be inserted.

When the base projection 7 of the bottom cover is pushed into the washer 21, the washer 21 will be spread since the cut-out 21*a* has been formed, and the washer 21 will be engaged with the washer engaging portion 7*d* of the base projection 7. When the base projection 7 in this state is further pushed into the opening 9*a* formed in the roof 9, the washer 21 will be reduced in diameter against the elastic force, because the cut-out 21*a* has been formed in the washer 21, and the washer 21 in a state fitted over the base projection 7 will be inserted into the vehicle room through the opening 9*a* formed in the roof 9.

Figure 7:
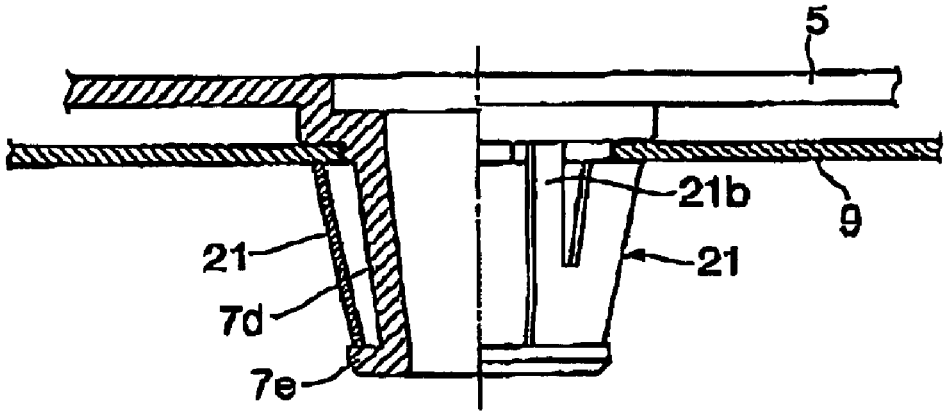
FIG. 7 is a view partly cut away showing a state in which the bottom cover and the washer have been mounted to the roof.

After the washer 21 has passed through the opening 9*a* formed in the roof 9, a pressure exerted on the washer 21 will be released, and the washer 21 will be recovered in shape by the elastic force up to the original diameter, as shown In FIG. 7. As the results, an upper end edge of the washer 21 will be brought into contact with the inner face of the roof 9, and the locking rib 7*e* provided on the base projection 7 of the bottom cover 5 will come into contact with the bottom face or the washer 21 thereby allowing the antenna device to be mounted and fixed.

Figure 8:
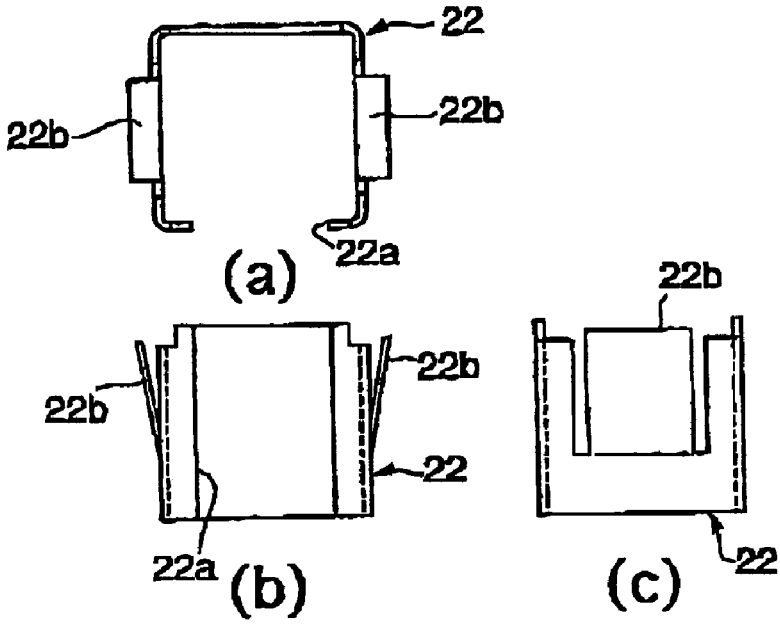
FIG. 8 shows still another embodiment of the washer, in which (a) is a plan view, (b) is a front view, and (c) is a side view.

FIG. 8 shows an embodiment of a washer 22 having a further different shape. Different from the two foregoing embodiments, this washer 22 has an angular cylindrical shape. There is formed a cut-out 22*a* in its one part in the same manner, but the locking claws 22*b* provided at the two right and left positions have only elastic portions which are inclined so as to simply spread outwardly. This is because the washer 22 having the angular cylindrical shape will not rotate with respect to the base projection 7 of the bottom cover 5, and so, it would be unnecessary to lock the locking pieces with respect to the base projection 7.

Figure 9:
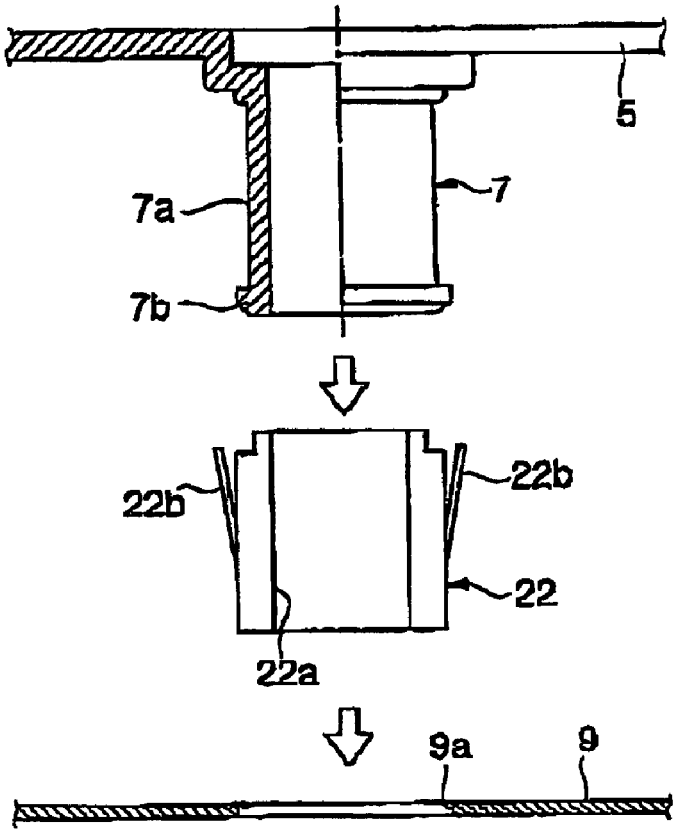
FIG. 9 is a view showing a step of mounting the bottom cover and the washer to the roof.

When the base projection 7 of the bottom cover 5 is pushed Into the washer 22 as shown in FIG. 9, the washer 22 will be spread since the cut-out 22*a* has been for, and the washer 22 will be engaged with the washer engaging portion 7*a* of the base projection 7. When the base projection 7 in this state is further pushed into the opening 9*a* formed in the roof 9, the locking claws 22*b* of the washer 22 will be pushed inwardly against the elastic force, and the washer 22 in a state fitted over the base projection 7 will be inserted into the vehicle room through the opening 9*a* formed in the roof 9.

Figure 10:
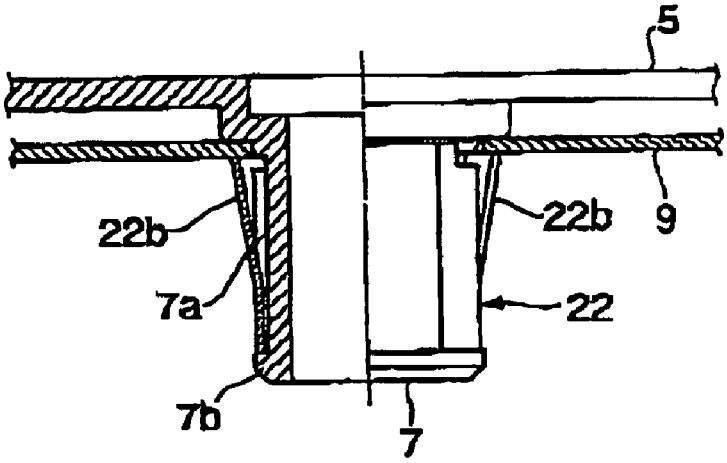
FIG. 10 is a view partly cut away showing a state in which the bottom cover and the washer have been mounted to the roof.

After the washer 22 has passed through the opening 9*a* formed in the roof 9, a pressure exerted on the locking claws 22*b* will be released, and the locking claws 22*b* will be recovered to their original shape by the elastic force so as to project outwardly, as shown in FIG. 10. As the results, the locking claws 22*b* of the washer 22 will be brought into contact with the inner face of the roof 9, and the locking rib 7*b* provided on the base projection 7 of the bottom cover 5 will come into contact with the bottom face of the washer 22 thereby allowing the antenna device to be mounted and fixed.

Figure 11:
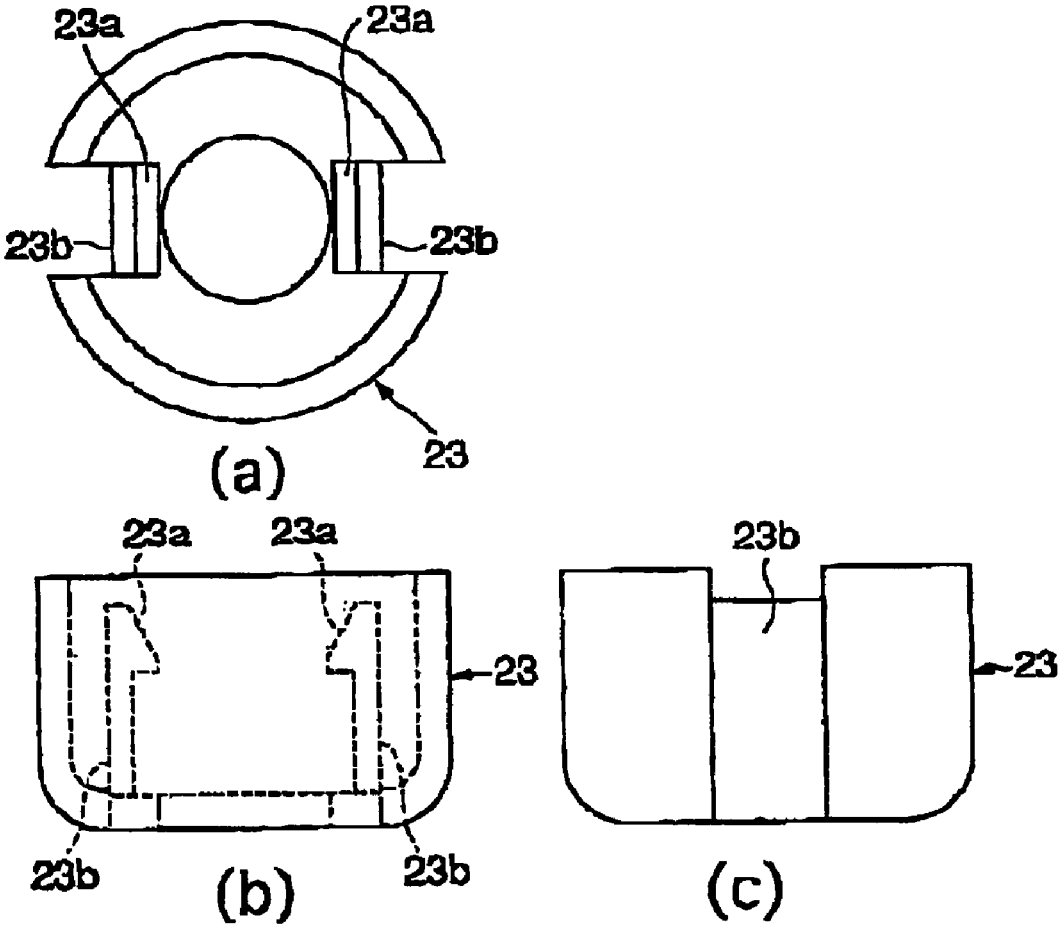
FIG. 11 shows still another embodiment of the washer, in which (a) is a plan view, (b) is a front view, and (c) is a side view.
Figure 12:
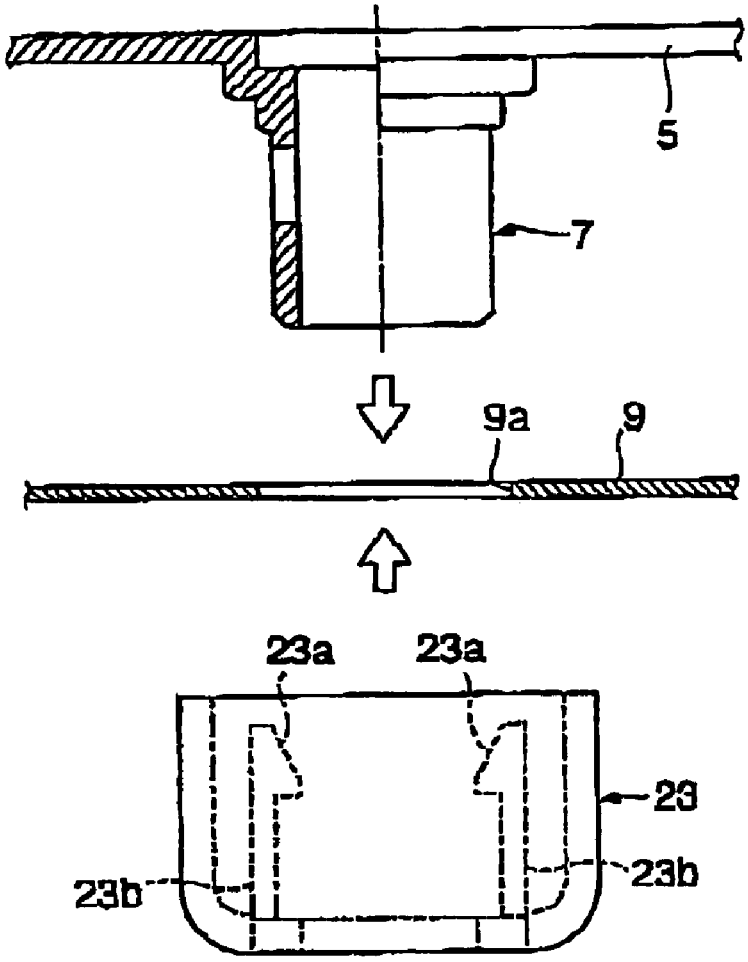
FIG. 12 is a view showing a step of mounting the bottom cover and the washer to the roof.

FIG. 11 shows an embodiment of a washer 23 which is different from the foregoing embodiments, and adapted to be mounted from the inside of the vehicle room. The washer 23 in this embodiment has a so-called cap-like shape. A pair of locking portions 23*b* having respective locking pieces 23*a* which are inwardly directed are formed uprightly in this washer 23.

Figure 13:
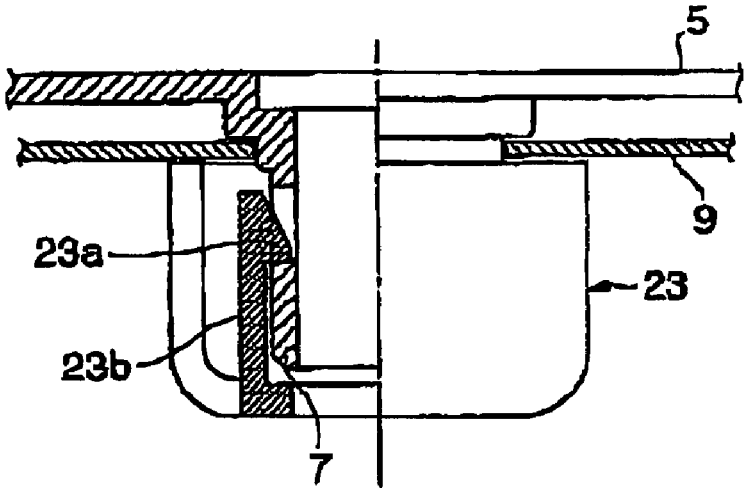
FIG. 13 is a view partly cut away showing a state in which the bottom cover and the washer have been mounted to the roof.

In case of this embodiment, the base projection 7 provided on the bottom cover 5 is inserted into the opening 9*a* formed in the roof 9 from the outside of the vehicle room, and the washer 23 is mounted to the inserted base projection 7 from the inside of the vehicle room. After the washer 23 has been mounted, the locking pieces 23*a* of the locking portions 23*b* are locked to the base projection 7 and mechanically fastened, as shown in FIG. 13. Then, the washer 23 will be brought into contact with the inner face of the roof 9, thereby allowing the antenna device to be mounted and fixed.

Although two persons are required to conduct the work in case of this embodiment, the mounting work can be extremely simply done, and the mounted state with high reliability can be obtained.

As apparent from the foregoing description, according to the antenna device of the invention, it is possible to provide an antenna device which can be easily mounted to a roof of an automobile even by one person, and can be maintained in a highly reliable state after mounted.

What is claimed is:

1. An antenna device attached on an outer face of a plate member having a through hole connecting the outer face and an inner face of the plate member, the electric device comprising:

an antenna element;

a cover, defining a space for covering the antenna element;

a tubular projection, extended from the cover member so as to communicate with the space, the projection inserted into the through hole from the outside to the inside of the plate member in a first direction; and a washer, comprising:

a semiannular body, elastically fitted on an outer periphery of the projection; and an elastic piece, elastically deformable in a second direction which is perpendicular to the first direction to allow the washer to pass through the through hole from the outside to the inside of the plate member together with projection, the elastic piece being brought into contact with the inner face when the washer is placed at the inside of the plate member.

2. The antenna device according to claim 1, wherein the washer is made of a metal.

3. The antenna device according to claim 1, wherein:

the projection comprises an annular lib extending in the second directions; and the washer is held between the inner face of the plate member and the lib.

4. The antenna device according to claim 1, wherein:

the elastic piece comprises a first part extended from the body while being spreading outwardly in a third direction which is opposite to the first direction.

5. The antenna device according to claim 4, wherein:

the elastic piece comprises a second part continued from the first part and extending inwardly; and the projection is formed with a first groove to allow the second part to move in the second direction.

6. The antenna device according to claim 1, wherein:

the washer comprises a pin;

the projection comprises a second groove coupled with the pin so as to restraint a circumferential displacement between the washer and the projection.

7. The antenna device according to claim 1, wherein the washer has an angular cylindrical shape.

8. A method of attaching an antenna device on an outer face of a plate member having a trough hole connecting the outer face and an inner face of the plate member, the method comprising steps of:

providing an electric device comprising:

an antenna device;

a cover, defining a space for covering the antenna element, and a tubular projection, extended from the cover member so as to communicate with the space;

providing a washer comprising a semiannular body and an elastic piece;

fitting elastically the semiannular body onto an outer periphery of the projection at the outside of the plate member;

inserting the projection, together with the washer, into the through hole from the outside to the inside of the plate member in a first direction, while deforming the elastic piece in a second direction perpendicular to the first direction; and placing the washer at the inside of the plate member while being the elastic piece onto contact with the inner face of the plate member.

* * * * *